United States Patent [19]

Ahlrich

[11] 4,093,432

[45] June 6, 1978

[54] ELECTROSTATIC PRECIPITATOR

[76] Inventor: Willard K. Ahlrich, 2227 Pine Lake Rd. NW., Stuart, Fla. 33494

[21] Appl. No.: 720,219

[22] Filed: Sep. 3, 1976

Related U.S. Application Data

[63] Continuation-in-part of Ser. No. 573,570, May 1, 1975, Pat. No. 4,018,578.

[51] Int. Cl.[2] ..... B03C 3/00

[52] U.S. Cl. ..... 55/138; 55/145; 55/148; 55/149; 55/152; 55/154

[58] Field of Search ..... 55/14, 120, 127, 149, 55/129, 130, 136–138, 145, 148, 150–153, 406; 361/231, 229

[56] References Cited

U.S. PATENT DOCUMENTS

| | | | |
|---|---|---|---|
| 2,119,297 | 5/1938 | Scott | 55/127 |
| 2,696,893 | 12/1954 | Richardson | 55/129 |
| 2,776,724 | 1/1957 | Goldschmied | 55/149 |
| 2,871,974 | 2/1959 | Werst | 55/130 |
| 2,873,000 | 2/1959 | Elam | 55/138 |
| 3,782,905 | 1/1974 | Huang et al. | 55/129 |
| 4,018,578 | 4/1977 | Ahlrich | 55/151 |

FOREIGN PATENT DOCUMENTS

| | | | |
|---|---|---|---|
| 620,108 | 1/1927 | France | 55/401 |

*Primary Examiner*—Bernard Nozick
*Attorney, Agent, or Firm*—Blanchard, Flynn, Thiel, Boutell & Tanis

[57] ABSTRACT

An electrostatic precipitator having a rotor supported for rotation within a housing containing inlet and outlet openings adjacent the opposite ends thereof. The rotor is formed by a plurality of ringlike collector plates which are fixedly connected in axially spaced relationship. One end of the rotor, as disposed adjacent the outlet opening, is closed by a support plate. The collector plates are alternately of opposite charge to create electrostatic fields therebetween. The collector plates have aligned central openings which decrease in diameter towards the closed end of the rotor. The plates also have equal surface areas so that substantially equal electrostatic fields are created between each adjacent pair of plates. The collector plates, in the radially outward direction, are sloped in a direction which is axially opposite to the direction of the gas supplied to the inlet opening. An ionizing device is disposed across the inlet opening to the rotor for ionizing the foreign particles entrained in the gas supplied thereto. The ionizing device includes a plurality of ionizing wires disposed perpendicular to the rotational axis of the rotor, which wires are uniformly spaced between grounded flow divider bars which also extend perpendicularly of the inlet opening.

17 Claims, 7 Drawing Figures

ELECTROSTATIC PRECIPITATOR

CROSS-REFERENCE TO RELATED APPLICATION

This application is a continuation-in-part of my copending application Ser. No. 573,570, filed May 1, 1975 now U.S. Pat. No. 4,018,578.

FIELD OF THE INVENTION

This invention relates to an improved air cleaning system and, in particular, to an improved electrostatic precipitator having ionizing and centrifugal rotor sections of improved configuration and efficiency.

BACKGROUND OF THE INVENTION

My copending application Ser. No. 573,570, filed May 1, 1975, discloses an electrostatic precipitator employing a rotor having a plurality of collector plates which are alternately charged for creating electrostatic fields therebetween. This rotor is rotatably driven and has the particle-laden gas passed therethrough for removing the particles due to the electrostatic charges which are created thereon by an ionizing section located upstream of the rotor. The rotor has a substantially cylindrical passage extending axially thereof, which passage is of a converging configuration to facilitate the uniform distribution of the gas outwardly between the adjacent pairs of collector plates. In addition, the collector plates are of substantially equal surface areas to provide electrostatic fields therebetween of uniform intensity. This results in the precipitator operating in a desirable manner to permit the efficient removal of substantial quantities of particles from the gas. At the same time, this design of the rotor permits a substantial quantity of gas to flow therethrough so that relatively large quantities of gas can be efficiently cleaned.

While the precipitator system disclosed in my abovementioned application has proven to operate in a successful manner, nevertheless additional research and development has been carried out in an attempt to still further improve the structure and operation of this system. Thus, this invention relates to further improvements which have been made in this electrostatic precipitator system, which improvements relate not only to the structure of the system but also to the resulting operation thereof.

More specifically, it is an object of the present invention to provide an improved electrostatic precipitator system, as aforesaid, which employs an improved centrifugal rotor wherein the collector plates are all sloped rearwardly as they project radially so that the gaseous stream in flowing radially outwardly between the collector plates is also displaced axially in a direction opposite to the gaseous stream which flows axially into the central opening of the rotor. This reversal in the flow direction of the stream as it flows radially outwardly between the adjacent collector plates is believed to improve the efficient removal of particles from the gaseous stream.

A further object of the present invention is to provide an improved electrostatic precipitator system, as aforesaid, employing an improved ionizing section disposed at the inlet end of the rotor, which ionizing section employs a plurality of ionizing wires forming a grid disposed within a plane which extends substantially perpendicular to the rotor axis. This ionizing section, in a preferred embodiment, employs a plurality of concentric loops defined by a plurality of concentric grounded flow divider elements disposed alternately between the ionizing wires. The wires and divider elements are all of a ringlike configuration, such as being octagonal. This ionizing section permits efficient ionization of the particles contained within the gaseous stream so that the particles can be removed by the rotor.

A still further object of this invention is to provide an improved electrostatic precipitator, as aforesaid, having improved structures associated therewith for permitting the collector plates and the ionizing section to be electrically charged.

Other objects and purposes of the invention will be apparent to persons familiar with systems of this type upon reading the following specification and inspecting the accompanying drawings.

Figure 1:
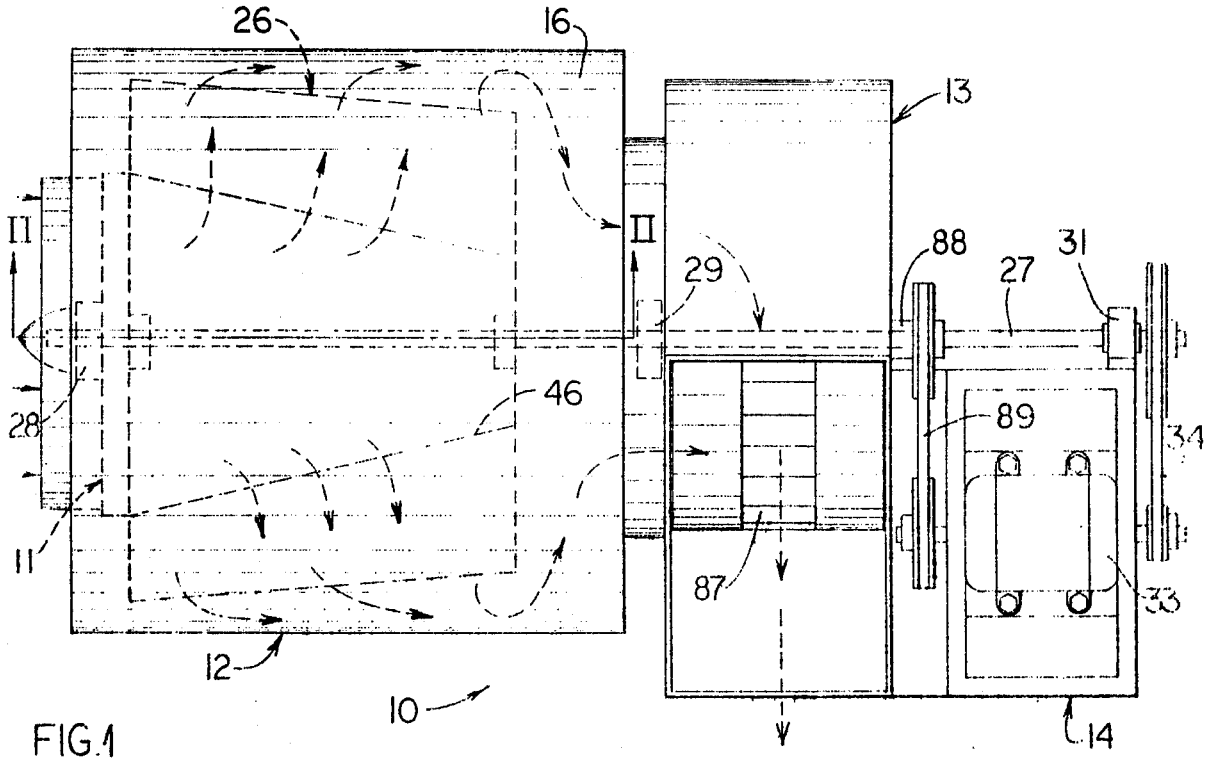
FIG. 1 is a top view of an air cleaning system according to the present invention.

Certain terminology will be used in the following description for convenience in reference only and will not be limiting. For example, the words "upwardly", "downwardly", "leftwardly" and "rightwardly" refer to directions in the drawings to which reference is made. The word "forwardly" refers to the normal flow direction of the gas through the precipitator, which flow occurs from left to right in FIGS. 1 and 2. The words "inwardly" and "outwardly" refer to directions toward and away from, respectively, the geometric center of the system and designated parts thereof. Said terminology includes the words specifically mentioned, derivatives thereof and words of similar import.

SUMMARY OF THE INVENTION

The objects of the present invention are met by providing an electrostatic precipitator having a rotor formed by a plurality of axially spaced, ring-shaped collector plates which are fixedly connected together to define a plurality of narrow channels which open radially outwardly between adjacent plates. The plates have aligned central openings which are of decreasing diameter. The plates are also of decreasing external diameter, whereby the plates are of equal surface area. The plates are alternately of opposite electrical charge so that electric fields of uniform intensity are created between the adjacent pairs of plates. The plates, as they extend radially outwardly, are slightly sloped so that they extend in an axial direction which is opposite to the inflowing direction of the air stream supplied to the central openings. An ionizing device extends transversely across the inlet end of the rotor. The ionizing device rotates with the rotor and includes a plurality of concentric ring-shaped ionizing wires which are uniformly spaced apart and separated by intermediate ring-shaped flow divider rings which are suitably grounded. The ionizing device thus defines a plurality of concentric flow channels which have uniform intensity electrostatic fields acting thereacross for ionizing the dust particles contained within the inflowing gaseous stream.

DETAILED DESCRIPTION

FIG. 1 illustrates a cleaning system 10 for removing dust and other solid particles from gases, such as air, which system includes an ionizing device 11, an electrostatic precipitator 12, a centrifugal blower 13 and a driving device 14.

Figure 2:
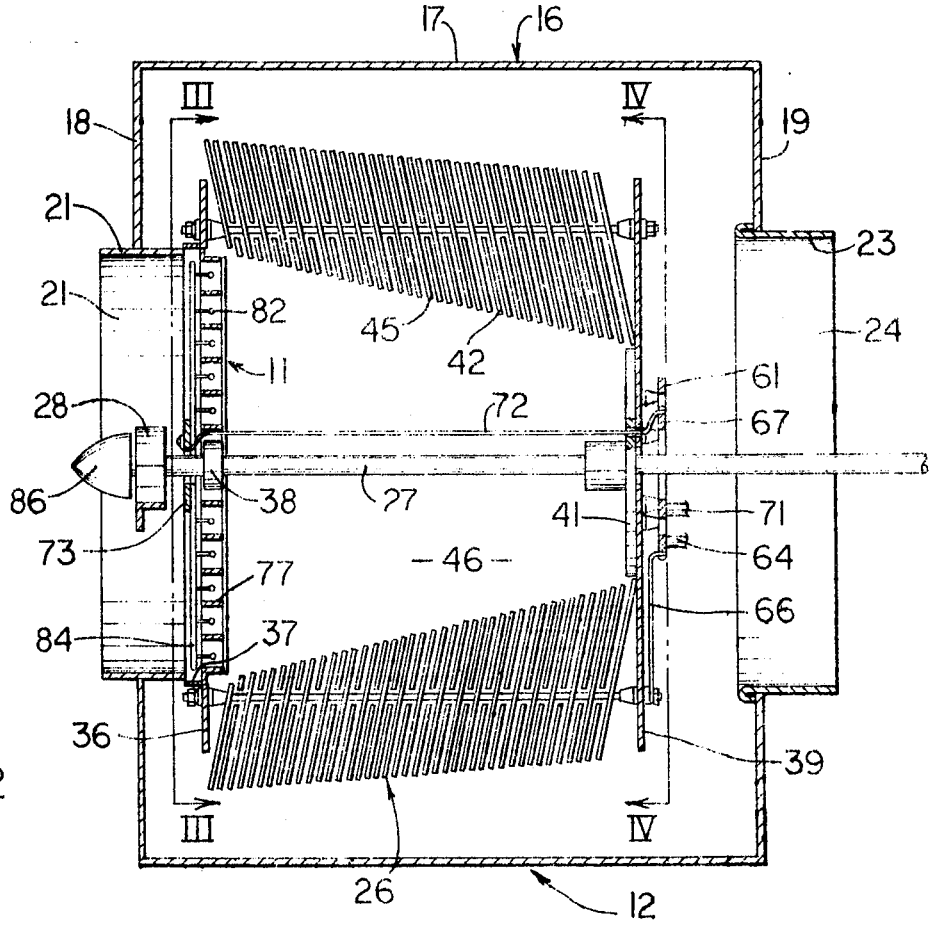
FIG. 2 is a fragmentary cross-sectional view of the electrostatic rotor as taken along the line II—II in FIG. 1.
Figure 3:
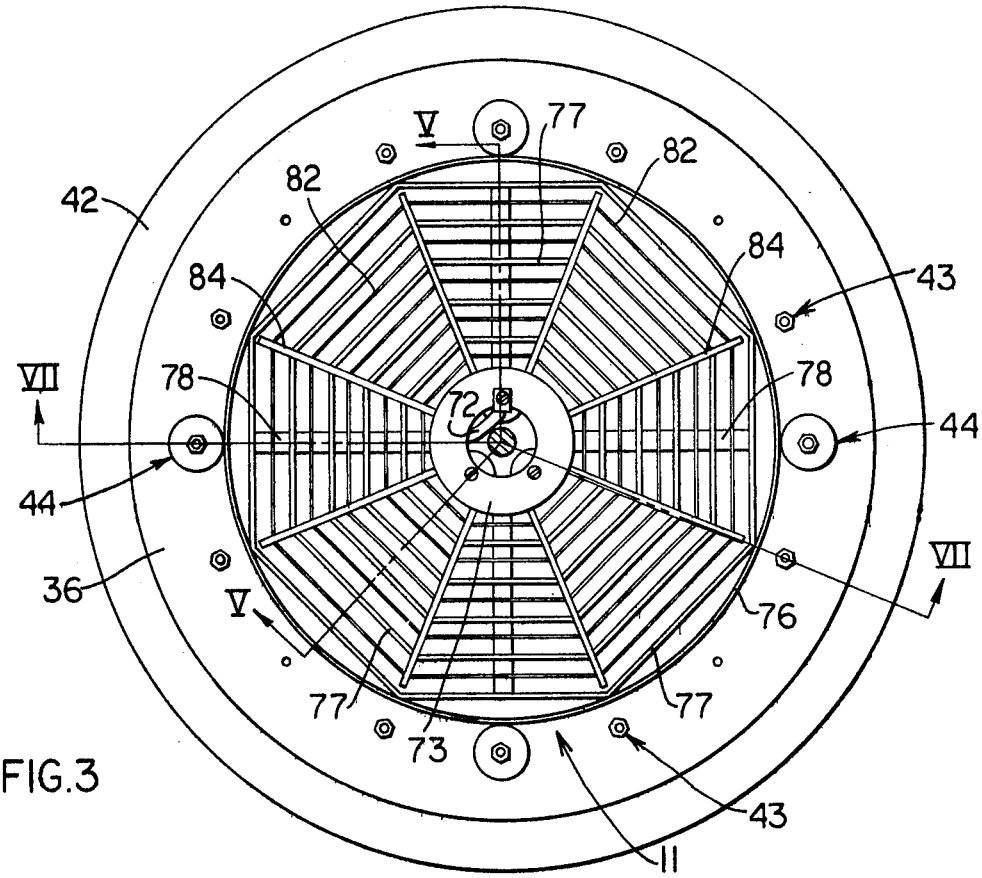
FIG. 3 is a view showing the inlet to the ionizing section, as taken along the line III—III in FIG. 2.
Figure 4:
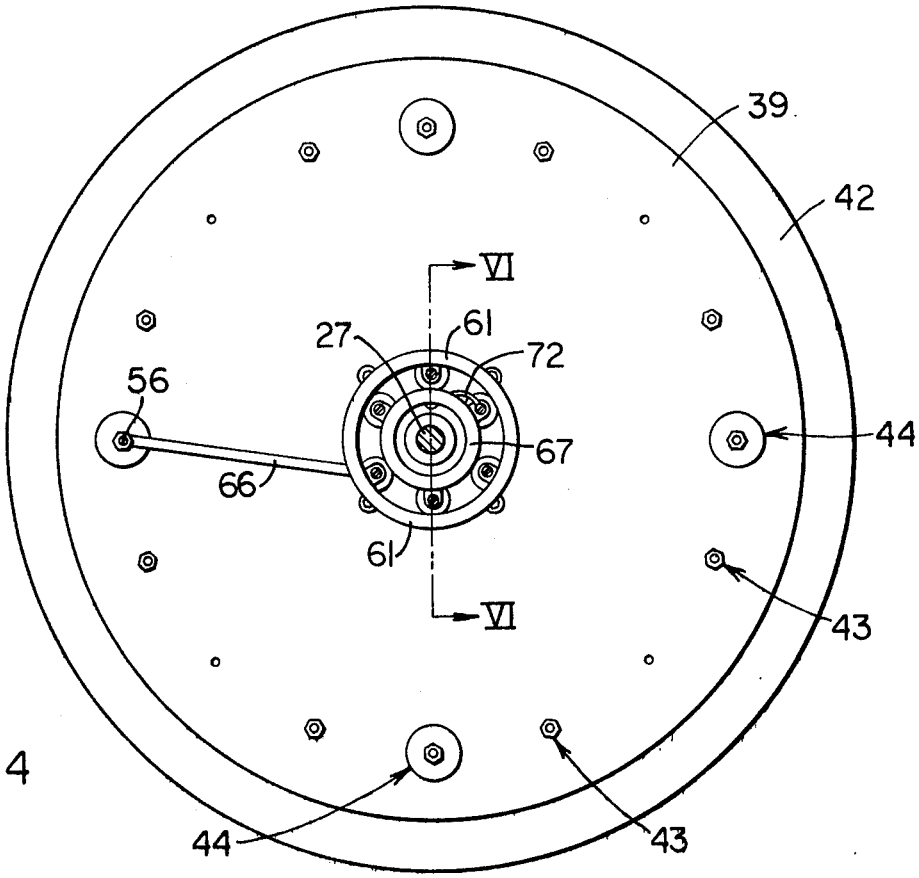
FIG. 4 is an end view of the rotor as taken along the line IV—IV in FIG. 2.

The electrostatic precipitator 12, as illustrated in FIG. 2, includes a cylindrical housing 16 formed by an annular side wall 17 and spaced end walls 18 and 19. An annular collar 21 is mounted on the end wall 18 concentric with the housing and defines an inlet opening 22. A further annular collar 23 is mounted on the end wall 19 so as to define an outlet opening 24 which is coaxially aligned with the inlet opening 22.

A precipitator member or rotor 26 is secured to a shaft 27 for rotation therewith, which shaft extends through the blower 13 and is rotatably supported by bearings 28, 29 and 31. The shaft 27 is aligned with the axis of the cylindrical housing 16 so that the rotor 26 is concentric therewith. Shaft 27 is driven by the driving device 14 which, as illustrated in FIG. 1, includes a conventional electric motor 33 drivingly interconnected to the shaft 27 by any suitable device, such as a belt transmission 34.

Rotor 26 includes an annular support plate 26 disposed adjacent the inlet end of the precipitator. The support plate 36 is fixedly connected to the ionizer housing 37, to be described hereinafter, which in turn is secured to a support hub 38 nonrotatably secured to the shaft 27.

A further annular support plate 39 is disposed adjacent the other end of the rotor 26 and includes a central hub member 41 which is fixed to the shaft 27 and closes the rearward end (rightward end in FIG. 2) of the rotor. The support plates 36 and 39 are disposed in axially spaced but parallel relationship to one another and are each fixed to the shaft 27 for rotation therewith.

Rotor 26 includes, in the space between the support plates 36 and 39, a plurality of circular ring-shaped collector plates 42 disposed concentric to and axially spaced along the shaft 27.

The plurality of collector plates 42 are axially fixed together in the desired relationship by tie-rod assemblies 43 and 44 (FIG. 7) which extend axially of the plates and are connected to the support plates 36 and 39, as described hereinafter.

The collector plates 42 have central openings 45 formed therein, which openings 45 are of progressively decreasing diameter as the plates extend axially inwardly from the inlet opening 22. The openings 45 thus form an elongated converging flow passage 46 which extends axially inwardly of the rotor from the inlet end thereof. The outside diameter of the collector plates 42 also progressively decreases in the axial direction of the rotor as it extends from the inlet end of the precipitator. As shown in FIG. 2, both the inside and outside diameters of the collector plates 42 progressively decrease from the inlet end of the rotor to the other end thereof so that both the inside and outside profiles of the rotor are of a truncated conical configuration. This progression in the inside and outside diameters of the collector plates 42 is selected so that all of the plates have the same surface area irrespective of their location axially of the rotor, but each plate has inside and outside diameters which are different from the inside and outside diameters of the other plates.

In addition, the collector plates 42 are preferably provided with a reverse slope thereon which induces a reverse axial flow of the gases as they pass between the adjacent collector plates. As shown in FIG. 2, the plates 42, as they extend radially outwardly from the central passage 46, are sloped axially rearwardly (that is, they are sloped back toward the inlet end of the precipitator), which slope as measured relative to the radial direction is normally within the range of 10° to 20°, and is preferably approximately 15°.

To permit the individual collector plates 42 to accommodate the tie-rod assemblies 43 and 44, each collector plate 42 has a set of 8 small diameter openings 48 (FIG. 7) formed therethrough, which openings 48 are disposed on a circular pattern concentric with the axis of the plate, and with the individual openings being equally angularly spaced from one another. Each opening 48 is surrounded by a flattened seating boss 49. Each plate 42 also has a set of four large diameter openings 47 formed therethrough, which openings are also disposed in a circular pattern concentric with the plate and with the individual openings 47 being equally angularly spaced from one another. In the illustrated embodiment, the openings 47 and 48 are all equally radially spaced from the axis of the rotor. The support plates 36 and 39 also have sets of openings formed therein in alignment with the openings 47 and 48 so as to permit the support plates to accommodate the tie-rod assemblies 43 and 44.

Figure 7:
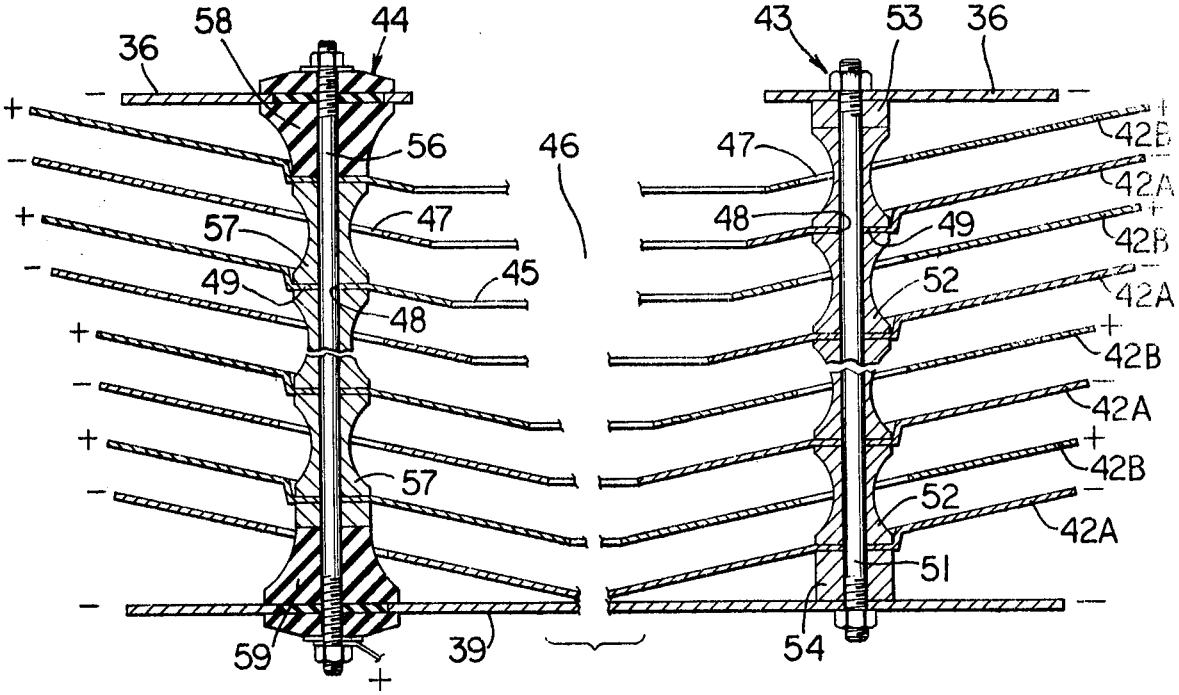
FIG. 7 is an enlarged, fragmentary sectional view taken along line VII—VII in FIG. 3.

As illustrated in FIG. 7, the collector plates 42 are disposed so that the openings 47 and 48 as formed in adjacent plates are alternately disposed in alignment with one another. That is, the openings 47 and 48 as formed in the uppermost collector plate are disposed so as to respectively align with the openings 48 and 47 formed in the second uppermost collector plate, which openings 48 and 47 in turn respectively align with the openings 47 and 48 formed in the third uppermost collector plate. This alternating sequence is repeated throughout the axial length of the rotor so that the openings 47 and 48 are thus aligned and disposed in an alternating sequence throughout the axial length of the rotor. The tie-rod assemblies 43 and 44 are thus associated with these alternating sequences of aligned openings 47 and 48.

The tie-rod assembly 43 includes an elongated tie-bolt 51 which extends through the aligned openings 47 and 48 and also extends through further aligned openings in the support plates 36 and 39. A plurality of spool-shaped spacer sleeves 52 are disposed in snug surrounding relationship to the tie-bolt 51, which spacer sleeves 52 snugly engage the alternating seating bosses 49 therebetween so that the spacer sleeves snugly clamp the alternate collector plates, designated 42A in the desired axially spaced relationship. At the same time, the spacer sleeves 52 pass through the enlarged openings 47 formed in the remaining alternate collector plates which have been designated 42B. Suitable end spacers 53 and 54 are positioned between the stack of spacer sleeves 52 and the support plates 36 and 39 for maintaining the tie-rod assembly 43 and the associated collector plates 42A in the desired positional relationship.

The tie-rod assembly 44 is similar to the assembly 43 in that it includes an elongated tie-bolt 56 which extends through the aligned openings 47 and 48 formed in the collector plates, and also extends through suitable enlarged openings formed in the support plates 36 and 39. Tie-bolt 56 is snugly surrounded by a plurality of spool-shaped spacer sleeves 57 which are identical to the sleeves 52. The sleeves 57 snugly clamp the seating bosses 49 of the collector plates 42B therebetween, whereas the spacers 57 pass freely through the enlarged openings 47 formed in the remaining collector plates 42A. A pair of electrical insulating sleeves 58 and 59 are disposed adjacent the ends of the stack of spacer sleeves 57 and are mounted on the support plates 36 and 39 for securing each tie-rod assembly 44 to the support plates.

Since the alternate collector plates 42A are all securely connected to the tie-rod assemblies 43 and the support plates 36 and 39, and since the support plates 36 and 39 are connected to the shaft 27 which functions as a ground or negative terminal for the precipitator, the plates 42A are thus the grounded or negatively-charged plates of the rotor. The remaining collector plates 42B, on the other hand, are electrically insulated from the support plates 36 and 39 due to the insulated spacers 58 and 59. These alternating collector plates 42B are thus the positively-charged plates of the precipitator, and are thus interconnected to a source of electrical potential.

To permit the plates 42B to be positively electrically charged, rotor 26 is provided with a ring-shaped conductor 61 fixedly secured to the rearward end thereof. Conductor 61 is disposed in surrounding relationship to the shaft 27 and is fixed to the support plate 39 by a plurality of bolts 62. A plurality of spacers 63, constructed of an electrical insulative material, are positioned between the conductor 61 and the support plate 39. The conductor 61 is electrically energized by an electrical slip contact 64 mounted on the precipitator housing, which slip contact is in turn energized from a conventional D.C. power source. The conductor ring 61 is in turn electrically connected by a conductive strap 66 to one of the tie-bolts 56 which, through the spacer sleeves 57, result in the alternate collector plates 42B being electrically energized. Since the remaining collector plates 42A are grounded, an electrostatic field is generated between each adjacent pair of plates 42A–42B. Since all of the plates 42 are equally axially spaced apart and are of equal surface area, the electrostatic fields generated between the adjacent pairs of collector plates are thus of substantially equal intensity throughout the complete length of the rotor.

Rotor 26 also has a further ring-shaped conductor 67 mounted thereon, which conductor is secured by bolts 68 to the support member 39, being electrically insulated therefrom by intermediate spacers 69. A further electrical slip contact 71 is maintained in engagement with the conductor ring 67 for electrically energizing same, which slip contact 71 is also connected to a D.C. electrical potential source. The conductor ring 67 is connected to an electrically conductive strap 72 which passes through a suitable opening formed in the support hub 41 and extends axially throughout the rotor so that the other end of strap 72 is connected to a conductive ring 73 associated with the ionizing device 11.

Figure 5:
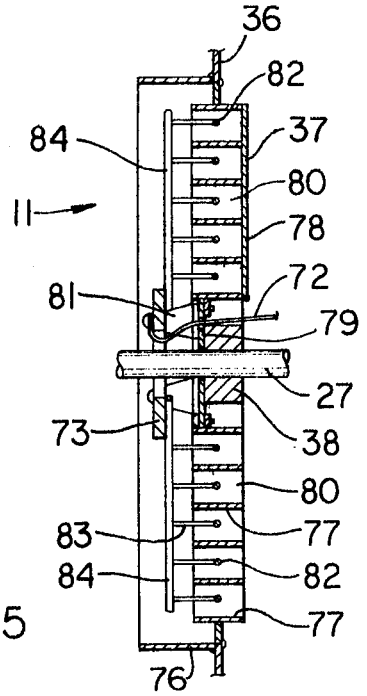
FIG. 5 is a cross-sectional view of the ionizing section as taken along line V—V in FIG. 3.
Figure 6:
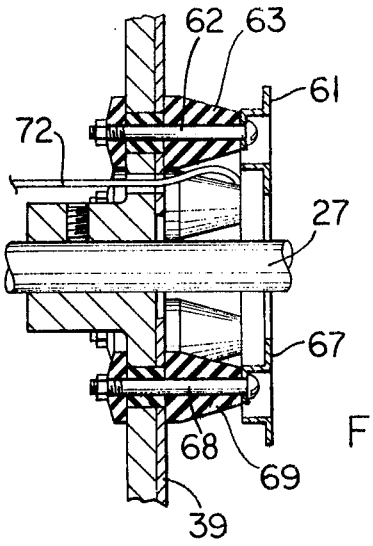
FIG. 6 is an enlarged, fragmentary sectional view taken along line VI—VI in FIG. 4.

Considering now the structure of the ionizing device 11, as shown in FIG. 5, the housing 37 thereof includes an annular collar 76 fixedly secured to the rotor support plate 36, so that the ionizing device thus rotates with the rotor. The collar 76 is positioned closely adjacent the housing collar 21 (FIG. 2) at the inner end thereof, and is of slightly larger diameter so that the inflowing gaseous stream is thus forced to flow through the ionizing device. The collar 76 of the ionizer housing in turn is fixedly connected to the outermost one of a plurality of concentric flow divider rings 77, which guide rings are uniformly radially spaced apart and in the illustrated embodiment are of an octagonal configuration. The plurality of guide rings 77 are rigidly joined together by a plurality, here four, of radially extending spokes 78. The innermost guide ring 77 is in turn rigidly secured to a hub plate 79 which is mounted on the support hub 38. The flow divider rings 77 are constructed from a thin platelike member to permit the free flow of the gaseous stream through the ionizing device. The rings 77 are grounded inasmuch as they are connected to the shaft 27.

To create an electrostatic field within the ionizing device, there is provided a plurality of ring-shaped ionizing wires 82 disposed in concentric relationship to one another. These wires 82 are, in the illustrated embodiment, of an octagonal configuration so that one wire 82 is disposed within each flow channel 80 as defined between each adjacent pair of guide rings 77. Each ionizing wire 82 is, as shown in FIG. 5, positioned centrally of the channel 80, as measured radially between the inner and outer rings 77 and axially between the inlet and outlet ends thereof. In a preferred embodiment, the divider rings 77 have an axial width of approximately two inches, the adjacent rings 77 are radially spaced apart by a distance of approximately $1\frac{1}{2}$ inches.

The ionizing wires 82 are connected to conductive elements 83 which extend axially outwardly to the front side of the ionizer and are joined to radially extending conductive spokes 84. These spokes 84 are in turn secured to the conductive ring 73, which ring is supported on the plate 79 by electrically insulative spacers 81.

The plurality of concentric ionizing rings 82 are disposed within a plane which exists substantially perpendicular to the axis of the rotor and is also perpendicular to the inflow direction of the gaseous stream, as defined by the inlet opening 22. The individual wires 82 also extend parallel to the grounded plates defined by the divider rings 77 so that electrostatic fields of substantially equal intensity are formed within the flow channels 80, which electrostatic fields are of substantially uniform intensity throughout the circumferential extent of each channel 80.

To streamline the flow into the ionizing device, the end of shaft 27 is preferably provided with a deflector thereon, such as the conical nose member 86 as shown in FIG. 2.

The gases are drawn into and through the ionizing device 11 and the electrostatic precipitator 12 by means of the blower 13, which may be of any conventional configuration. In the illustrated embodiment, blower 13 includes a conventional blower wheel 87 disposed within a suitable housing. Blower wheel 86 is secured to a shaft 88 which rotatably surrounds the shaft 27 and is driven from the motor 33 by means of a suitable belt transmission 89. The blower wheel 86 has an axially directed inlet opening which communicates and is aligned with the outlet end of the precipitator, and the blower wheel causes the gases to be discharged through a suitable discharge opening for supply to a further conduit or for discharge into the surrounding atmosphere.

OPERATION

When the air cleaning system 10 is to be operated, the conductor rings 61 and 67 are energized through the associated slip contacts from suitable D.C. sources, which sources can be of different potential to thereby result in the ionizing wires 82 and collector plates 42B being electrically charged at different power levels. The energization of collector plates 42B results in electrostatic fields being generated between each adjacent pair of collector plates 42A–42B, with the electrostatic field between each adjacent pair of plates being the same due to the plates being of equal area and uniformly axially spaced apart. The energization of the ionizing wires 82 also results in the generation of electrostatic fields of substantially equal intensity within each of the flow channels 80 which extend axially through the ionizing device.

When motor 33 is energized, blower wheel 87 and rotor 26 are simultaneously rotated. The blower wheel causes gas or air with dust and other contaminating particles therein to be drawn through the ionizing device 11, whereupon the air passes through the channels 80 containing therein the electrostatic fields. This causes ionization of the air so that the foreign particles entrained in the air are given a positive electrostatic charge. The air then flows into the elongated converging passage 46 formed within the rotor 26 and, due to the suction created by the blower wheel 87, and due also to the centrifugal effect created by rotation of the rotor, the air within passage 46 flows radially outwardly through the narrow channels defined between the collector plates 42A–42B which channels are acted upon by an electrostatic field. Since the foreign particles were previously positively charged by the ionizing device 11, these particles collect on the surface of the grounded or negatively-charged plates 42A as the air flows radially outwardly between the collector plates. The resulting clean air is then deflected axially of the housing 16 and flows through the discharge opening 24 so as to be supplied to the inlet of the blower 13.

Since the central openings 45 of the collector plates 42 are of progressively decreasing diameter, the thus formed passage 46 functions in a manner similar to a conical opening in that the resistance to flow in the axial direction of the passage 46 increases as the inflowing air approaches the closed end (rightward end in FIG. 2) of the rotor. The increased resistance caused by the decreasing diameter of the passage 46 causes substantial equal volumes of air to be radially discharged outwardly between each adjacent pair of collector plates 42A–42B along the axial length of the rotor. Further, since each collector plate has substantially the same surface area, the electrostatic field between each adjacent pair of plates is substantially the same, so that each adjacent pair of collector plates is thus equally effective in removing foreign particles from the air.

The removal of the charged foreign particles from the air is further facilitated by the fact that the collector plates 42 are all provided with a reverse slope as the plates extend radially outwardly. This reverse slope causes the air, as it flows radially outwardly between the adjacent plates 42A–42B, to also move axially through a limited extent in a direction opposite to the inflowing axial direction of the air within the conical passage 46. This reversal in the axial flow direction of the air as it moves from the passage 46 into the narrow electrostatically charged channels between the plates, which axial reversal occurs again when the air leaves the channels between the plates and flows axially rightwardly along the periphery of the housing, thus causes greater movement of the air and of the charged particles so as to ensure that the particles are appropriately collected on the grounded plates 42A.

The foreign particles which collect on the plates 42A accumulate on these plates until they form small globular masses which, due to centrifugal force, slowly slide radially outwardly along the collector plates until they are discharged tangentially from the plates. The discharged masses are collected within the housing 16, from which they are periodically removed by cleaning the housing with steam, warm water or other suitable cleaning solutions.

The ionizing wires 82 are preferably charged with a potential of between 12 and 16 kilovolts, with the wires normally carrying from 8 to 12 milliamperes. The positively-charged collector plates 42B, on the other hand, are preferably subjected to a potential of from 6 to 10 kilovolts, and are normally subjected to from 6 to 10 milliamperes.

While the present invention preferably utilizes a plurality of collector plates wherein all of the plates are of different size so that the axially-arranged stack of plates has progressively decreasing inside and outside diameters, nevertheless it will be appreciated that the rotor could utilize a plurality of different sets of collector plates with the different sets being of progressively decreasing inside and outside diameters, substantially as taught in my above-mentioned application Ser. No. 573 570.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In an electrostatic precipitator having a plurality of annular, axially spaced apart, parallel collector plates, said collector plates being axially aligned and each having a central opening therethrough, the central openings of said collector plates being aligned to define an axially elongated gas-receiving passage surrounded by said plurality of collector plates, inlet means associated with one end of said plurality of collector plates for permitting a gaseous stream to be supplied into said gas-receiving passage and then flow radially outwardly through channels defined between the adjacent collector plates, an end plate disposed adjacent the other end of said plurality of plates for closing the other end of said passage, ionizing means associated with said inlet means for ionizing the gaseous stream flowing therethrough, means for electrically insulatively supporting alternate ones of said collector plates from the others of said collector plates, and electrical connection means for supplying voltage to said alternate collector plates and said ionizing means, comprising the improvement wherein the central openings of at least some of said collector plates are of decreasing diameter as the plates extend from one end thereof to the other end thereof so that the axially elongated gas-receiving passage decreases in cross-sectional area as it extends from said inlet means to said end plate, and wherein said plurality of plates extend at a nonperpendicular angle with respect to the axial direction of said passage so as to define a reverse slope as measured with respect to a radially outwardly extending direction which results in the radially outer edges of said plates being axially positioned between the radially inner edges of the plates and said inlet means.

2. A precipitator according to claim 1, wherein said collector plates are of a truncated conical configuration.

3. A precipitator according to claim 1, wherein said collector plates as they extend radially outwardly from the inner to the outer peripheral edges thereof are sloped at an angle of between 10° and 20° relative to the radially outwardly extending direction.

4. A precipitator according to claim 1, wherein the outer diameter of at least some of the collector plates decreases in size as the plates extend from said inlet means toward said end plate so that all of said collector plates have substantially equal surface areas, and drive means connected to said plurality of collector plates for causing rotation thereof about the longitudinally extending axis defined by said passage.

5. A precipitator according to claim 4, wherein said collector plates are of a truncated conical configuration and are substantially uniformly axially spaced apart.

6. In an electrostatic air cleaning system having a housing with an inlet opening at one end thereof and an outlet opening spaced from said inlet opening, a precipitator rotor disposed within and rotatably supported relative to said housing for rotation about the longitudinal axis of the rotor, said precipitator rotor being formed from a plurality of annular plates which are fixedly connected in axially spaced-apart but parallel relationship, each of said plates having a central opening therethrough, the central openings of said plurality of plates being aligned to define an axially elongated gas-receiving space which is opened at one end thereof, the opened end of said space being disposed adjacent said inlet opening, said precipitator rotor having an end plate which closes the other end of said space, means associated with said precipitator rotor for creating electrostatic fields between said plates, drive means for causing rotation of said rotor, and ionizing means for ionizing the gaseous stream which is supplied into said space through the opened end thereof, comprising the improvement wherein said ionizing means is mounted on said precipitator rotor for rotation therewith and includes ionizing wire means disposed adjacent the opened end of said space and extending transversely thereacross.

7. An air cleaning system according to claim 6, wherein said ionizing means includes an annular support member fixed to said precipitator rotor in concentric and surrounding relationship to said gas-receiving passage at said one end thereof, spoke means fixed to said support member and extending inwardly therefrom in transverse relationship to said space, said ionizing means including a plurality of flow divider plates fixed to said spoke means, said flow divider plates comprising a plurality of concentric rings positioned at the open end of said space and disposed in radially spaced relationship, said ionizing means also including a plurality of concentric electrically conductive loops positioned alternately between the flow divider rings in substantially perpendicular relationship to the axial direction of said space, means for supplying electrical potential to said loops, and said rings being electrically grounded, whereby an electric field is created between the loops and the adjacent flow divider rings for ionizing the particles within the gaseous stream as it flows through the channels defined between the adjacent rings.

8. An air cleaning system according to claim 7, wherein said precipitator rotor includes an elongated rotatable shaft extending coaxially of said gas receiving space and defining said longitudinal axis, said plurality of annular plates being fixed to said shaft, and said ionizing means being supported on and rotatable with said shaft adjacent the opened end of said space.

9. An air cleaning system according to claim 6, wherein said ionizing means includes a plurality of spaced apart, substantially parallel flow divider plates extending across the opened end of said space in substantially perpendicular relationship to the axial direction of said space, and said ionizing wire means including a plurality of substantially parallel and spaced apart ionizing wires, each of said wires being disposed parallel to and spaced substantially midway between a pair of said flow divider plates so that said wires also extend substantially perpendicular to the axial direction of said space.

10. An air cleaning system according to claim 9, wherein said plurality of flow divider plates comprise a plurality of concentric rings positioned at the open end of said space and disposed in radially spaced relationship, and wherein said ionizing wires comprise a plurality of concentric electrically conductive loops positioned alternately between the flow divider rings.

11. An air cleaning system according to claim 10, wherein each of said flow divider rings and ionizing loops is of a polygonal shape.

12. An air cleaning system according to claim 10, wherein all of said annular plates have substantially equal surface areas so that electric fields of substantially equal intensity are created between the adjacent pairs of plates.

13. An air cleaning system according to claim 12, wherein the central openings defined by said annular plates are of progressively decreasing diameter as said plates extend from the opening end of said space to the closed end thereof, and wherein the external diameters of said annular plates are also of decreasing diameter as the plates extend from the opened end to the closed end of said space, whereby the variation in the internal and external diameters of the plates in the axial direction of the rotor causes all of the plates to be of substantially equal surface area.

14. An air cleaning system according to claim 13, wherein the plates are all sloped rearwardly as they project radially outwardly so that the radially inner peripheral edge of each annular plate is disposed axially between the radially outer peripheral edge of the respective plate and the closed end of said passage.

15. In an air cleaning system having duct means defining an opening through which flows a particle-laden gaseous stream, ionizing means associated with said opening for ionizing the particles contained within said gaseous stream, and an electrostatic precipitator device disposed downstream of said ionizing means for removing the ionized particles from the gaseous stream, said precipitator device including a precipitator member formed from a plurality of annular collector plates disposed in spaced apart parallel relationship with said plates being alternately of opposite electrical charge for creating electrostatic fields therebetween, said plurality of collector plates defining an elongated flow receiving passage extending centrally thereof so that said gaseous stream flows through said ionizing means and into said passage and then radially outwardly between the adjacent collector plates, said precipitator member including an end plate which closes the end of said passage which is opposite from said ionizing means, and means supporting said precipitator member for rotation about the longitudinally extending axis of said passage, comprising the improvement wherein said ionizing means is fixed to said precipitator member for rotation therewith, said ionizing means extending transversely across the opening and including a plurality of substantially concentric flow divider rings positioned within said opening and being spaced apart from one another in the radially extending direction of said opening, said ionizing means also including a plurality of looplike ionizing wires disposed in concentric relationship with one another and positioned so that the looplike wires are disposed alternately between the flow divider rings, first and second ringlike conductors mounted on said end plate and being respectively associated with first and second slip contacts which are connected to at least one source of D.C. potential, first means electrically connecting the first ringlike conductor to alternate ones of the collector plates, and second means electrically connecting the second ringlike conductor to said looplike wires for creating an electric field between each wire and the adjacent rings for ionizing the particles within the gaseous stream as it flows through the channels defined between the adjacent rings, said second means including an elongated electrically conductive wire extending axially throughout the length of said passage.

16. An air cleaning system according to claim 15, wherein said rings are uniformly radially spaced apart, and wherein said looplike ionizing wires are also uniformly radially spaced apart so that the individual wires are disposed radially midway between the adjacent rings.

17. An air cleaning system according to claim 16, wherein said looplike ionizing wires and said rings are all of a polygonal shape.

* * * * *